US006921854B2

(12) United States Patent
Gatzen

(10) Patent No.: US 6,921,854 B2
(45) Date of Patent: Jul. 26, 2005

(54) GROOVED DRUM BODY CONSTRUCTION

(75) Inventor: Robert A. Gatzen, Wethersfield, CT (US)

(73) Assignee: Avedis Zildjian Company, Norwell, MA (US)

( * ) Notice: Subject to any disclaimer, the term of this patent is extended or adjusted under 35 U.S.C. 154(b) by 0 days.

(21) Appl. No.: 10/443,632

(22) Filed: May 22, 2003

(65) Prior Publication Data

US 2004/0231490 A1 Nov. 25, 2004

(51) Int. Cl.[7] ..... G10D 13/02
(52) U.S. Cl. ..... 84/411 R
(58) Field of Search ..... 84/411 R, 17, 84/18, 99, 421, 211 A, 411.7; 446/265, 297, 318, 397, 418

(56) References Cited

U.S. PATENT DOCUMENTS 4,045,264 A * 8/1977 Ludwig et al. ..... 156/63
4,137,815 A * 2/1979 Kloc ..... 84/408
5,981,858 A * 11/1999 Jeng ..... 84/411 R
6,515,208 B2 * 2/2003 Cleland ..... 84/411 R

* cited by examiner

*Primary Examiner*—Kimberly Lockett
(74) *Attorney, Agent, or Firm*—Shook, Hardy & Bacon L.L.P.

(57) ABSTRACT

A metallic drum shell has grooves which enhance its acoustical properties to provide a warmer and less harsh sound. The grooving can be a continuous spiral groove formed in the outside surface of the drum shell. The grooves can be formed with selected depths, widths, contours and frequencies in order to achieve the desired fundamental pitch, resonance and overtone suppression.

19 Claims, 3 Drawing Sheets

GROOVED DRUM BODY CONSTRUCTION

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates generally to musical drums and more particularly to a drum having a cylindrical body or shell that is grooved in a manner to enhance its acoustical properties.

BACKGROUND OF THE INVENTION

Musical drums have a long history of development and have advanced significantly in recent years. For example, snare drums date back at least to the period of the American Civil War. Snare drums became integrated as parts of drum sets in the early 1900s and have been a principal component of drum kits ever since.

The snare drum has a unique characteristic that involves the use of "snares" which are currently constructed using metallic wire for the most part. The wires or snares are stretched across the bottom drum head to produce a raspy tone that gives the snare drum its unique sound which is different from the tom-toms or bass drum of the drum set. The snare drum is essentially a tom-tom with snares added. Snare drums are commonly considered to be an alternative sound source that defines the natural accents of a musical composition.

For many years, the snare drum construction was essentially standard. The drum shell was made of either wood or metal and had between six and ten tension rods for tuning the drum head. The nature of the sound (known as the "timbre") that is provided by a metallic shell is distinctly different from that provided by a wood shell. Metallic shells are typically tin or galvanized steel that produces more volume and sound projection than a wooden shell. More recently, the design of snare drums has become more sophisticated as various enhancements have been developed to provide different sound effects. One example is a cast drum shell made of a bronze alloy that has achieved considerable popularity. Other efforts have been made to use various metals such as copper, brass and titanium to control the timbre of the metallic snare drum while preserving the projection in tone.

SUMMARY OF THE INVENTION

The present invention is directed to a drum shell that is grooved in order to enhance its acoustical characteristics when used in a snare drum or other type of drum such as a bass drum or tom-tom. The provision of grooves that are strategically contoured and sized allows custom tailoring of various acoustical properties, including the fundamental resonating frequency, overtones and resonance of the drum shell. The grooves can effectively control excessive high frequency content (sibilance) that is inherent in a metallic shell. Consequently, upper harmonics and overtones are suppressed to expose the lower frequencies to a greater extent. The overall result is a consistent "warmer" tone with extended dynamic range and projection.

In accordance with the invention, the grooves are preferably formed in a spiral configuration around the outside surface of the drum shell. Alternatively, the grooves can be separate circles on the shell. Their depth, width, sectional contour and frequency or spacing can be varied widely in order to achieve the intended effect. For example, it has been found that the fundamental pitch is effected most significantly by the depth of the grooves, particularly the groove depth in comparison to the thickness of the drum shell. Resonance can be controlled by changing the width of the grooves. As the groove width increases, the resonance decreases. Overtone suppression and content can be controlled by changing the contour or shape of the groove. More inclined sides of the grooves generally results in less overtone suppression. By varying the angles, shapes and lengths of the groove walls and bass, the overtone suppression can be adjusted to meet virtually any requirements that are desired. The number and spacing of the grooves effects all tone elements, including pitch, resonance and overtones.

It is an important object of the invention to provide a drum shell that is strategically grooved in a manner to allow control over its acoustical qualities.

Another object of the invention is to provide a drum shell of the character described in which the depth, width, contour and spacing of the grooves can be widely adjusted in order to achieve virtually any desired combination of acoustical characteristics of the drum.

A further object of the invention is to provide a drum shell of the character described that can serve as the body of various types of drums, including snare drums, bass drums and tom-toms.

An additional object of the invention is to provide a drum shell of the character described that can be constructed in a simple and economical manner.

Other and further objects of the invention, together with the features of novelty appurtenant thereto, will appear in the course of the following description.

BRIEF DESCRIPTION OF THE SEVERAL VIEWS OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
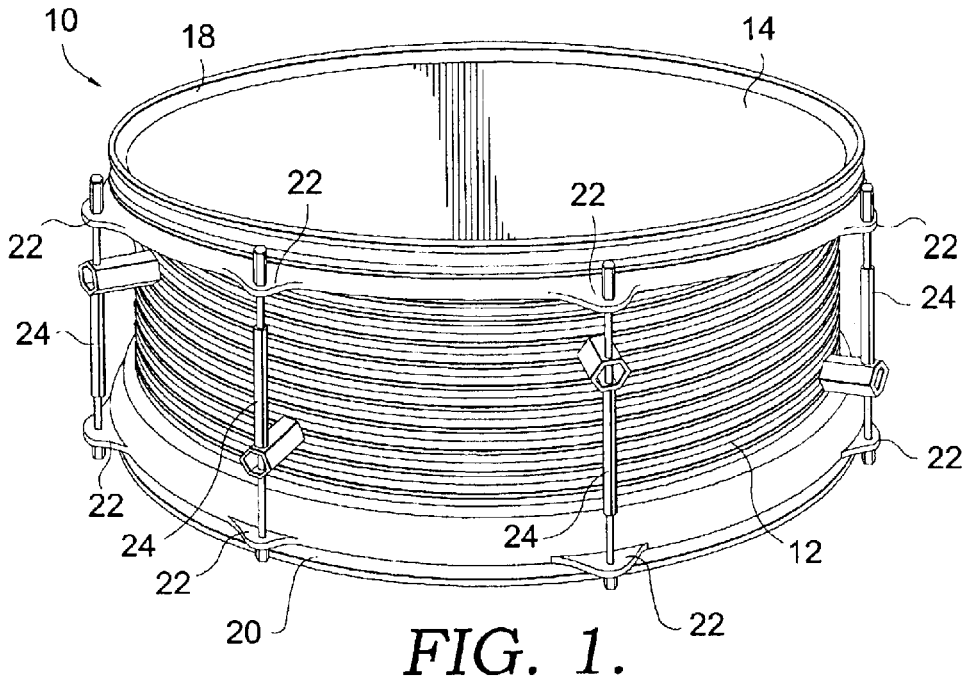
FIG. 1 is a perspective view of a musical drum having a grooved drum shell constructed according to one embodiment of the present invention.
Figure 2:
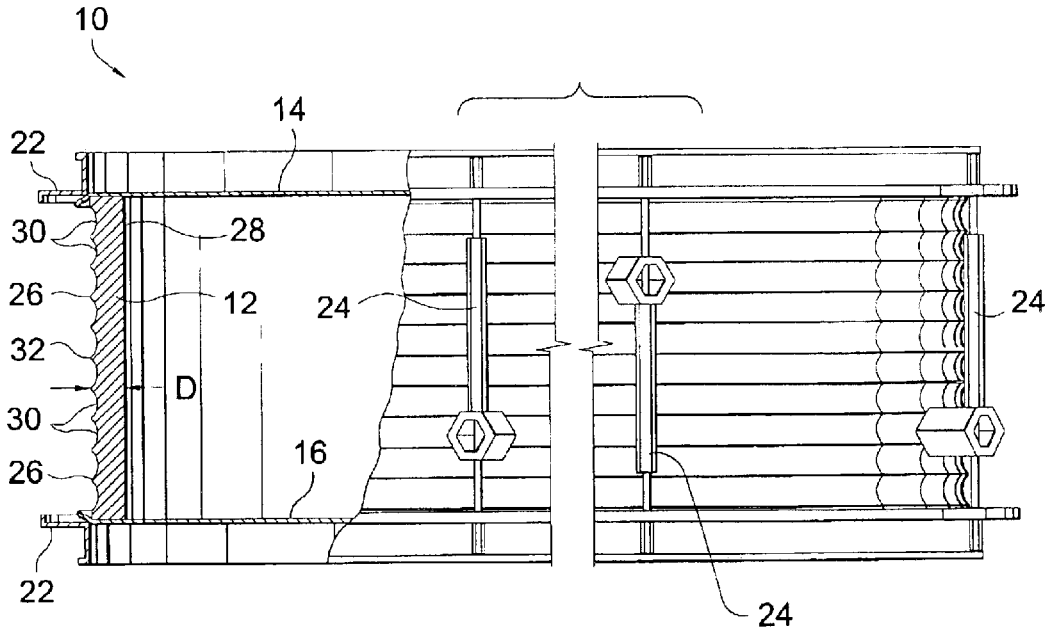
FIG. 2 is a side elevational view, partially in cross-section, of the drum shown in FIG. 1.

Referring now to the drawings in more detail and initially to FIGS. 1–2, numeral 10 generally designates a musical drum constructed according to one embodiment of the present invention. The drum 10 has a body which is formed by a hollow cylindrical shell 12 preferably constructed of a suitable metal. An upper drumhead 14 is stretched across the top of the shell, while a lower drumhead 16 is stretched across the bottom of the shell. Upper and lower rims 18 and 20, respectively, engage the peripheral edge portions of the upper and lower drumheads 14 and 16 and are provided with projecting lugs 22. Tension rods 24 extend between the upper and lower lugs 22 and may be tightened to increase the tension of the drumheads and loosened to loosen the drumhead tension. The tensioning mechanism is conventional and is familiar to those having ordinary skill in musical drum technology.

The present invention is directed to the construction of the drum shell 12. As best shown in FIG. 2, the shell 12 has a cylindrical wall which presents an outside surface 26 and an inside surface 28. The thickness of the wall of shell 12 is identified by the dimension D in FIG. 2 and is the distance between the outside surface 26 and the inside surface 28. In accordance with the invention, the shell 12 is provided with a grooved surface which is preferably the outer surface 26. Thus, a plurality of grooves 30 may be formed in the outside surface 26. The inside surface 28 may be smooth. Preferably, the adjacent grooves 30 are actually formed as a single continuous spiral groove that extends around the entire height of the drum shell 12. Alternatively, the grooves 30 can be formed as individual circular grooves spaced apart on the drum shell. While the grooves are depicted as being in the outer surface of the drum shell, they may also be formed on its inside surface.

The grooves 30 shown in FIG. 2 are continuously curved in their contour when viewed in section. Each groove 30 extends into the outside surface of the wall of shell 12 to present a concave configuration that occupies an arc of a circle. Adjacent grooves 30 preferably intersect with one another at lines 32 which extend around the body of the drum. Alternatively, the grooves 30 can be separated with a smooth angular band (not shown) extending around the drum shell between adjacent grooves.

Figure 3:
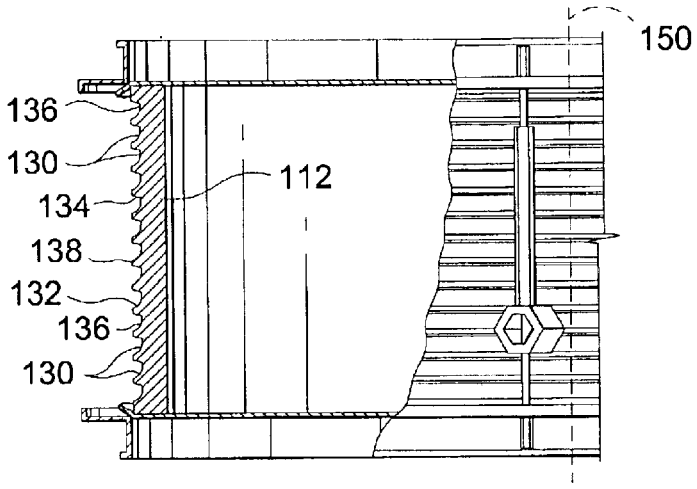
FIG. 3 is a fragmentary elevational view, partially in section, similar to FIG. 2, but showing a groove pattern in accordance with an alternative embodiment of the invention.

FIG. 3 shows an alternative embodiment of the invention in which the outside surface of the wall of shell 12 is provided with grooves 130 that differ in their configuration from the grooves 30. Each groove 130 has a pair of substantially flat opposite side surfaces 132 and 134 and a substantially flat base 136 at the depth of the groove that extends between the inner edges of each pair of side surfaces 132 and 134. The base 136 is substantially parallel to a central longitudinal axis 150 of the drum shell 112. The side surfaces 132 and 134 of each pair are inclined to the longitudinal axis 150, with the surfaces 132 and 134 of each groove being inclined at different angles to the axis 150. Each surface 134 is inclined less drastically than the corresponding surface 132, although other configurations are possible. Flat circular bands 138 are formed between adjacent grooves 130 on the outside surface of the shell wall.

Figure 4:
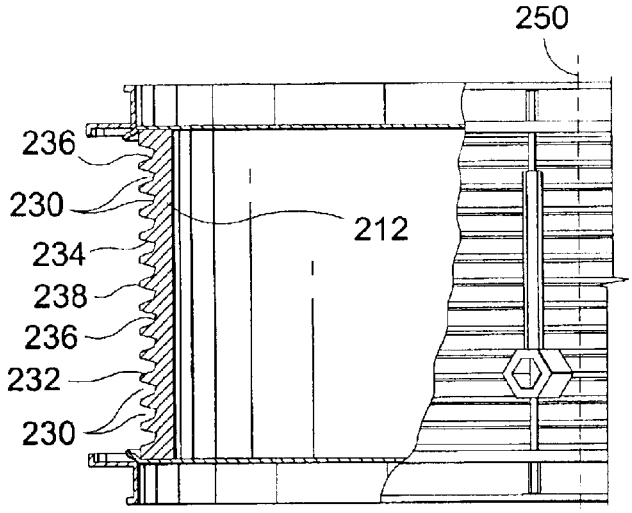
FIG. 4 is a fragmentary elevational view, partially in section, similar to FIGS. 2–3, but showing a groove pattern in accordance with another embodiment of the invention.

FIG. 4 depicts another alternative embodiment of the invention in which a cylindrical drum shell 212 is provided with grooves 230 extending into its outside surface. Each groove 230 has a pair of flat side surfaces 232 and 234 and a flat base 236. The base 236 is inclined at an angle to the central longitudinal axis 250 of the drum shell 212. The side surfaces 232 and 234 are inclined to the longitudinal axis of the drum shell and may be inclined at substantially the same angles but at different directions (or at different angles if desired). A generally flat band 238 is provided between each adjacent pair of grooves 230 on the outside surface of the shell wall.

Figure 5:
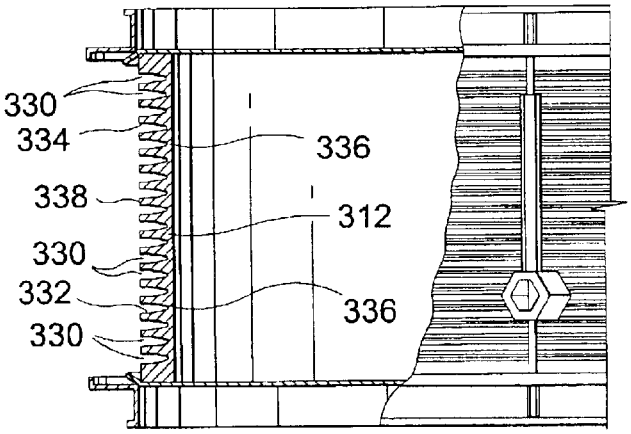
FIG. 5 is a fragmentary elevational view, partially in section, similar to FIGS. 2–4, but showing a groove pattern in accordance with yet another embodiment of the invention.

FIG. 5 depicts still another embodiment of the invention in which a cylindrical drum shell 312 is provided on its outside wall surface with a plurality of grooves 330 which may be formed as a single spiral groove or as separate circumferential grooves. Each groove 330 has a pair of opposite side surfaces 332 and 334 which are curved in a concave configuration when viewed from within the groove 330. The side surfaces 332 and 334 may be constructed as mirror images of one another and may intersect at a base of the groove forming a line 336. Alternatively, the base of each groove 330 may take the form of a flat band. On the outside wall surface of the shell 312, flat bands 338 may be formed between adjacent grooves 330.

Figure 6:
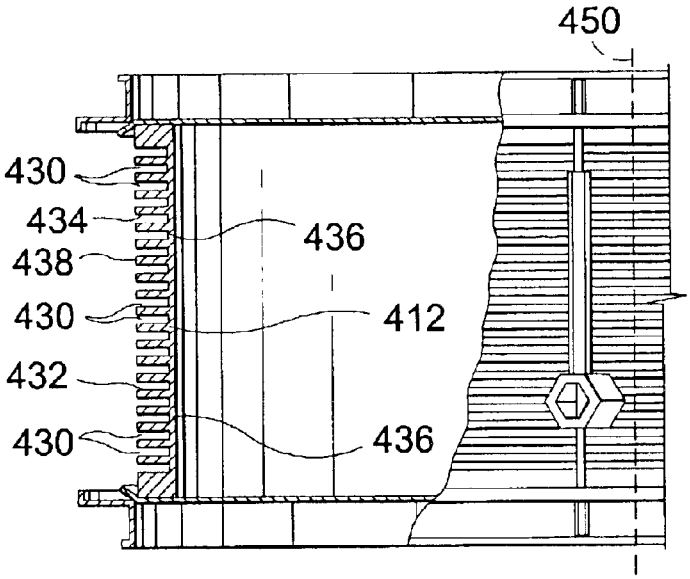
FIG. 6 is a fragmentary elevational view, partially in section, similar to FIGS. 2–5, but showing a groove pattern arranged according to still another embodiment of the invention.

FIG. 6 illustrates still another embodiment of the invention in which a cylindrical drum shell 412 has a plurality of grooves 430 extending into its outside surface. Each of the grooves 430 has opposite flat side surfaces 432 and 434 and a flat base 436. The side surfaces 432 and 434 may be parallel to one another and may be perpendicular to the base 436. The surfaces 432 and 434 may be substantially perpendicular to the longitudinal axis of the drum shell, while the base 436 may be substantially parallel to the longitudinal axis 450 of the drum shell. The grooves 430 extend through a substantial portion of the thickness of the drum shell 412. Flat bands 438 may be formed between each adjacent pair of grooves 430 on the outside surface of the shell wall.

Figure 7:
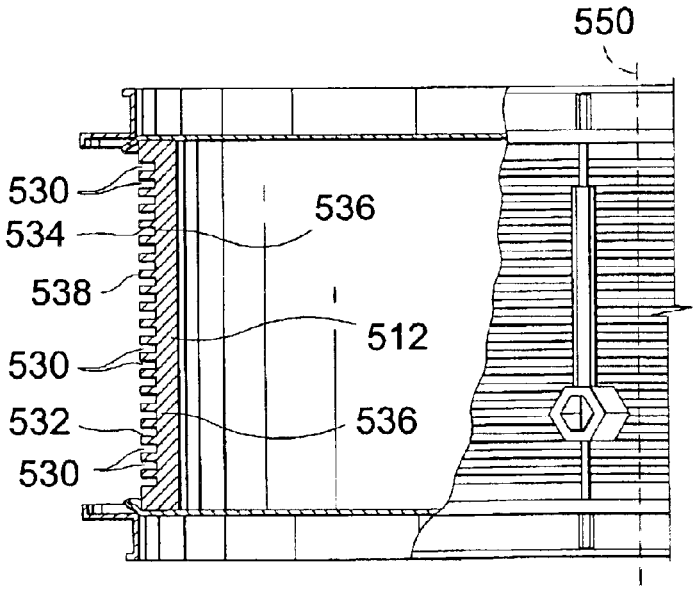
FIG. 7 is a fragmentary elevational view, partially in section, similar to FIGS. 2–6, but showing a groove pattern arranged according to another embodiment of the invention.

FIG. 7 shows still another alternative embodiment of the invention in which a cylindrical drum shell 512 is provided with grooves 530 which may have substantially the same configuration but a lesser depth than the grooves 430. Each groove 530 has opposite side surfaces 532 and 534 and a flat base 536. The surfaces 532 and 534 may be parallel to one another and substantially perpendicular to the longitudinal axis 550 of the drum shell. Each base 536 may be substantially parallel to the longitudinal axis of the drum shell and thus substantially perpendicular to the side surfaces 532 and 534. Flat bands 538 are formed between adjacent grooves 530 on the outside surface of the shell wall.

The relative depth, thickness, contour and frequency or spacing of the grooves can be varied in order to provide the drum shell with different acoustical characteristics. The depth of the grooves relative to the thickness D (FIG. 2) of the wall of the drum shell has a significant effect on the fundamental pitch (the actual pitch produced by striking the drum shell without hardware mounted on it). In general, the lower the pitch, the warmer the tone. The thickness dimension D typically ranges generally from 0.050–500 inch. If a strong material such as titanium is used to construct the drum shell 12, the depth of the groove can be up to 90% of the thickness dimension D of the drum shell. Conversely, if copper or another relatively soft metal is used, the maximum groove depth should not exceed about 60% in order to preserve the structural integrity and strength of the shell. It is generally preferred for the groove depth to be at least 10% of the overall shell thickness. Thus, the depth of the grooves can be in the range of approximately 10–90% of the shell wall thickness, depending largely upon the strength of the material used to construct the shell. Preferably, a groove depth in the range of about 10–25% of the shell thickness is used.

The width dimension of each groove (the maximum distance across the groove between its opposite sides) has a significant effect on the resonance of the drum. As the groove width increases, resonance decreases.

The contour or shape of the groove when viewed in section can be varied in order to vary the overtone suppression and content. The more inclined the sidewall surfaces of the grooves is, the less overtone suppression the grooves provide. For example, inclined sidewall surfaces such as the surfaces 132 and 134 in FIG. 3 and the surfaces 232 and 234 in FIG. 4 provide less overtone suppression than the parallel surfaces 432 and 434 in FIG. 6 and 532 and 534 in FIG. 7. By using different inclinations for the two side surfaces 132 and 134, a compromise effect can be provided. Similarly, by angling the base 236 to the longitudinal axis of the drum shell, the effect on the overtone suppression can be adjusted.

The frequency of the grooves (the number of grooves along the length or height of the drum shell (or the number of grooves per unit distance along the length of height of the drum shell) has an effect on all of the tone elements provided by the drum, including an effect on the fundamental pitch, the resonance and overtones. Thus, the frequency or spacing between the grooves can be adjusted to provide global control over all vibrational characteristics of the drum shell.

Grooves having a curved contour such as shown in FIGS. 2 and 5 may be used for "fine tuning" of the acoustical properties of the drum, and the curvature may be varied as desired, depending upon the effect that is to be obtained. Similarly, providing the base of each groove with either a flat configuration or a simple line configuration controls the acoustical properties accordingly.

Thus, by utilizing grooves having the desired combination of depth, width, shape and frequency, virtually any desired acoustical properties of the drum shell can be obtained. In all cases, the upper harmonics and overtones are suppressed to provide more exposure for the low frequencies and a "warmer" tone of the drum with extended dynamic range and projection. At the same time, the grooving results in a drum shell vibration that provides a consistent and repeatable sound desirable to drummers and listeners.

The drum shell in accordance with the present invention can be constructed of a wide variety of materials. Preferably, the shell is constructed of a suitable metal, including metals such as copper, bronze, brass, titanium, various alloys and a wide variety of other metals that have been used in the past and may be developed in the future. The drum shell may also be a wood structure provided with grooves.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. A body for a musical drum, comprising:

a hollow shell having a substantially cylindrical wall that has an inside surface and an outside surface; and a plurality of grooves in said outside surface of said wall for influencing the vibrational qualities of said shell, said grooves extending around said wall generally circumferentially.

2. A drum body as set forth in claim 1, wherein said grooves are formed in a spiral configuration extending around said wall.

3. A drum body as set forth in claim 1, wherein each of said grooves has a continuously curved contour in section.

4. A drum body as set forth in claim 1, wherein:

said shell has a central longitudinal axis; and each of said grooves has a contour in section presenting a pair of substantially flat side surfaces and a substantially flat base.

5. A drum body as set forth in claim 4, wherein said side surfaces are inclined at different angles to said longitudinal axis.

6. A drum body as set forth in claim 5, wherein said base is substantially parallel to said longitudinal axis.

7. A drum body as set forth in claim 4, wherein said base is at an angle to said longitudinal axis.

8. A drum body as set forth in claim 7, wherein said side surfaces are inclined to said longitudinal axis at substantially the same angel but opposite directions.

9. A drum body as set forth in claim 4, wherein said side surfaces are inclined to said longitudinal axis at substantially the same angel but opposite directions.

10. A drum body as set forth in claim 4, wherein said side surfaces are substantially parallel to one another and substantially perpendicular to said longitudinal axis.

11. A drum body as set forth in claim 1, wherein:

said shell has a central longitudinal axis; and each of said grooves has a contour in section presenting a pair of side surfaces that are curved in a concave configuration when viewed from within said groove, said side surfaces intersecting a base of the groove.

12. A drum body as set forth in claim 11, wherein said base of the groove comprises a line where said side surfaces intersect one another.

13. A drum body as set forth in claim 1, wherein said wall has a thickness and each groove has a depth into said outside surface in the range of approximately 10% to 90% of the wall thickness.

14. A drum body as set forth in claim 13, wherein said depth of each groove is in the range of about 10% to 25% of the wall thickness.

15. A musical drum body, comprising:

a hollow shell having a substantially cylindrical wall; and means for grooving said wall to influence the musical qualities of said shell in a manner to provide a substantially continuous groove spiraling around said wall for a plurality of revolutions.

16. A musical drum comprising:

a hollow shell forming a drum body having a substantially cylindrical wall that has an outside surface;

at least one drum head covering an end of said shell; and a plurality of grooves in said outside surface of said wall for influencing the musical properties of the drum, said grooves extending around said wall generally circumferentially.

17. A body for a musical drum, comprising:

a hollow shell having a substantially cylindrical wall and a central longitudinal axis; and a plurality of grooves in said wall extending generally circumferentially around the wall for influencing the vibrational qualities of said shell, each of said grooves having a contour in section presenting a pair of substantially flat side surfaces and a substantially flat base.

18. A body for a musical drum, comprising:

a hollow shell having a substantially cylindrical wall; and a plurality of grooves in said wall extending generally circumferentially around the wall for influencing the vibrational qualities of said shell, each of said grooves having a pair of side surfaces generally facing one another and spaced apart from one another.

19. A musical drum comprising:

a hollow shell forming a drum body having a wall;

at least one drum head covering an end of said shell; and a plurality of grooves in said wall extending generally circumferentially around the wall for influencing the musical properties of the drum, each of said grooves having a pair of side surfaces generally facing one another and spaced apart from one another.

* * * * *